United States Patent [19]

Johnson

[11] 4,278,038

[45] Jul. 14, 1981

[54] COMBINED NEEDLE GUARD AND HOOK BEAK FOR A SEWING MACHINE HOOK

[75] Inventor: Ralph E. Johnson, Convent Station, N.J.

[73] Assignee: The Singer Company, Stamford, Conn.

[21] Appl. No.: 103,661

[22] Filed: Dec. 14, 1979

Related U.S. Application Data

[63] Continuation of Ser. No. 22,536, Mar. 21, 1979, abandoned.

[51] Int. Cl.[3] ..... D05B 57/08; D05B 57/06

[52] U.S. Cl. ..... 112/228

[58] Field of Search ..... 112/181, 184, 227, 228, 112/231

[56] References Cited

U.S. PATENT DOCUMENTS

| | | | |
|---|---|---|---|
| 657,400 | 9/1900 | Dimond et al. | 112/227 X |
| 1,431,380 | 10/1922 | Dickson | 112/228 |
| 2,074,849 | 3/1937 | MacBride | 112/227 X |
| 2,883,953 | 4/1959 | Johnson | 112/228 |
| 3,063,392 | 11/1962 | Ketterer et al. | 112/181 |
| 3,120,204 | 2/1964 | Ketterer | 112/228 |
| 3,140,681 | 7/1964 | Corey | 112/228 |
| 3,215,105 | 11/1965 | Kuhar | 112/228 |
| 3,465,700 | 9/1969 | Kuhar | 112/228 |
| 3,955,519 | 5/1976 | Weisz | 112/228 |
| 4,094,261 | 6/1978 | Ketterer et al. | 112/228 |

FOREIGN PATENT DOCUMENTS

| | | | |
|---|---|---|---|
| 51-130431 | 11/1976 | Japan | 112/228 |
| 51-142933 | 11/1976 | Japan | 112/228 |
| 88625 | 1/1957 | Norway | 112/231 |

*Primary Examiner*—Wm. Carter Reynolds

*Attorney, Agent, or Firm*—William V. Ebs; Robert E. Smith; Edward L. Bell

[57] ABSTRACT

A sewing machine hook is provided with a combined needle guard and hook beak which is mounted in the rim of a hook so as to cause the guard to be engaged by a needle when the path of rotation of the hook beak, and the combined needle guard and hook beak to be pivoted into a position preventing the hook beak from engaging the needle.

5 Claims, 5 Drawing Figures

COMBINED NEEDLE GUARD AND HOOK BEAK FOR A SEWING MACHINE HOOK

This is a continuation of application Ser. No. 22,563, filed Mar. 21, 1979, now abandoned.

BACKGROUND OF THE INVENTION

1. Field of the Invention: The invention relates to sewing machine hooks including a hook beak for seizing loops of needle thread during the formation of lock stitches.

2. Description of the Prior Art: It is well known to provide a sewing machine hook with a hook beak which can be adjusted by an operator so as to position it relative to a needle and thereby avoid having the hook beak engage and break the needle. It is also known to provide a sewing machine hook with a needle guard effective during rotation of the hook to engage a needle which may be in the path of rotation of the hook beak and bend the needle out of the way of the hook beak to avoid contact between the two and consequent damage to the needle or hook beak.

In arrangements requiring the operator to position the hook beak so as to avoid interference with a needle there is always the possibility of the hook beak coming dislodged from its adjusted position. Furthermore, the operator is inconvenienced by having to concern himself with adjustments to the hook beak. Also, if the operator should forget to adjust the hook beak, as for example when a new needle of a greater diameter than a previously used needle is inserted in the machine, damage to the new needle or the hook beak, or to both may insue. The use of a needle guard which serves to bend a needle out of the way of a hook beak has disadvantages in that repeated flexing of the needle may result in fatigue failure causing the needle to snap.

It is a prime object of this invention to provide a sewing machine hook with an improved arrangement which functions automatically to prevent interference between a needle and hook beak, which does not require adjustment by an operator, and which avoids the necessity of bending the needle away from the hook beak.

SUMMARY OF THE INVENTION

In accordance with the invention, a sewing machine hook including a hook body and shaft for rotating the hook body is provided in an outer rim of the hook body with a combined needle guard and hook beak. The combined needle guard and hook beak is mounted in the rim for rotation thereby and for pivotal movement about an axis which is substantially parallel to the shaft axis. The needle guard is disposed for contact by any needle in the path of rotation of the hook beak so as to cause the combined needle guard and hook beak to be pivoted by the needle into a position preventing the hook beak from engaging the needle. Centrifugal force acting on the needle guard and hook beak and tending to pivot the combined needle guard and hook beak is effectively counteracted by a counterbalancing arm thereon extending from the pivotal axis in a direction opposite to that of the needle guard and hook beak.

DESCRIPTION OF THE PREFERRED EMBODIMENT

Figure 1:
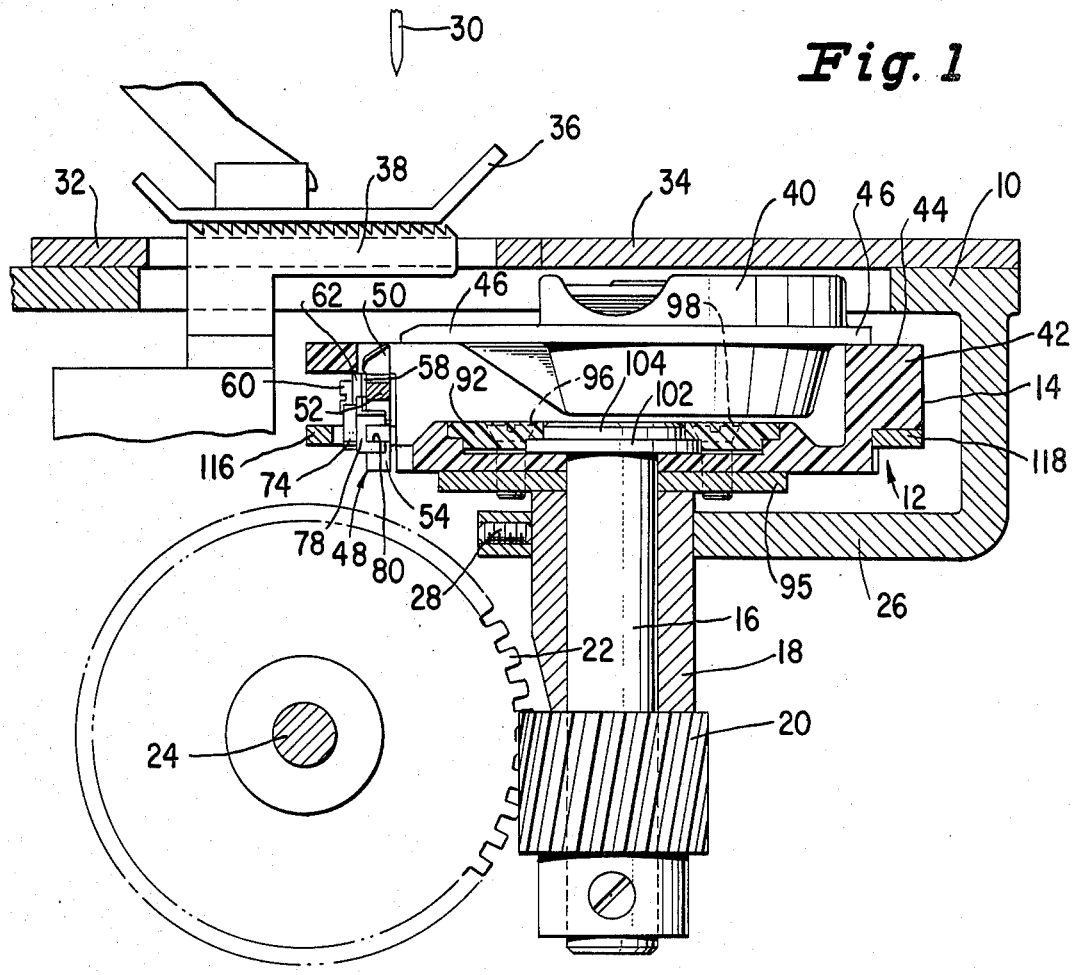
FIG. 1 is a vertical sectional view on the plane of the line 1—1 of FIG. 2 and showing a hook according to the invention in the bed of a sewing machine.
Figure 2:
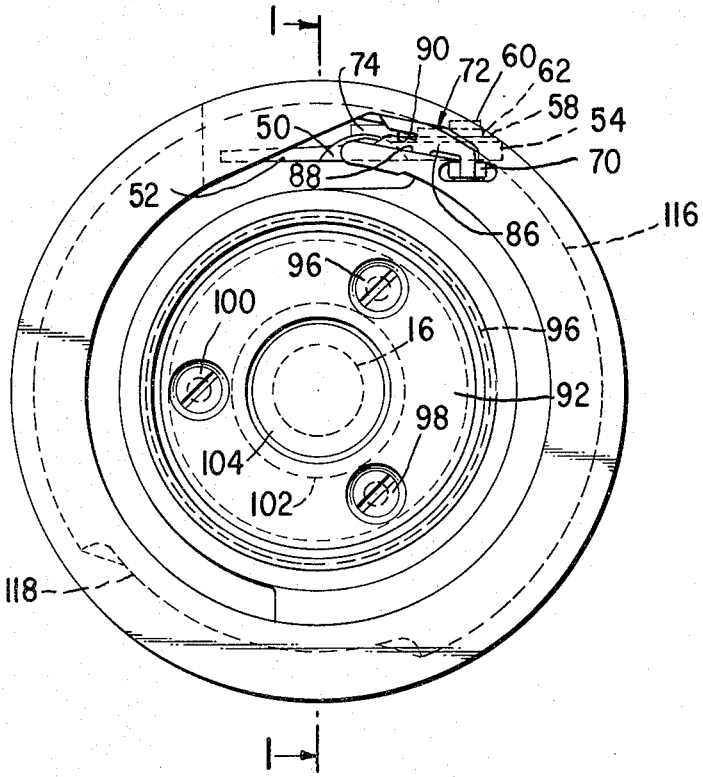
FIG. 2 is a top plan view of the hook of the invention.
Figure 3:
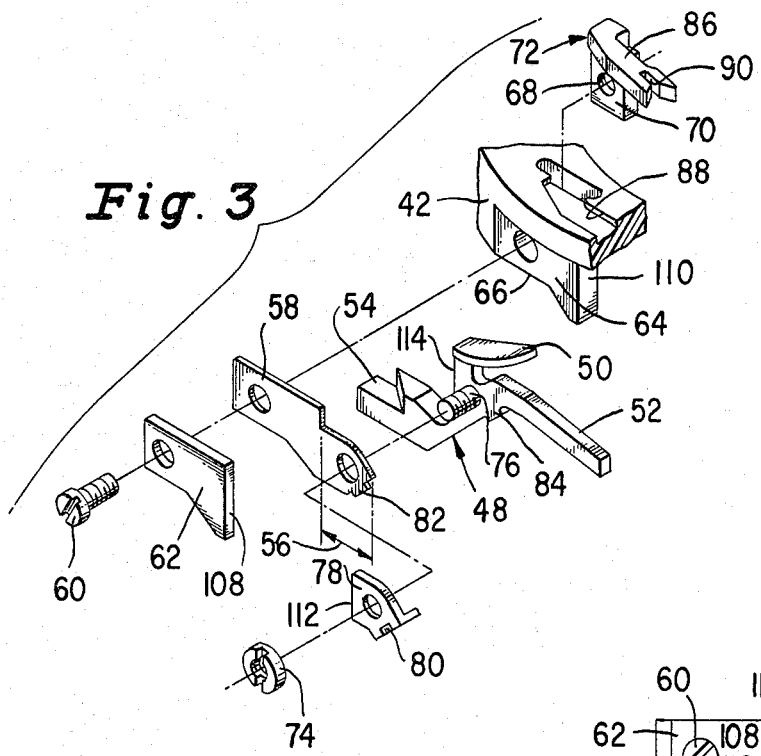
FIG. 3 is an exploded perspective view showing the combined needle guard and hook beak of the invention.
Figure 4:
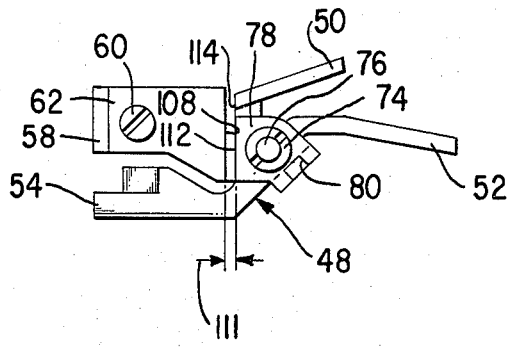
FIG. 4 is an elevational view of the combined needle guard and hook beak.

Referring to the drawings, reference character 10 designates a portion of the bed of a sewing machine wherein a hook 12 according to the invention is rotatably mounted. The hook includes a hook body 14 formed of a plastic material, and a shaft 16 for rotating the hook body. Shaft 16 extends through a bushing 18 and has a worm gear 20 secured thereon which meshes with and is driven by a gear 22 mounted on the bed shaft 24 of the machine. As shown, the bushing 18 is supported in the bed on a web 26 to which the bushing is affixed by a screw 28. Reference character 30 designates a sewing needle with which the hook 12 cooperates and which is reciprocated endwise by conventional actuating mechanism. The usual removal throat and slide plates 32 and 34 respectively are provided to support work being sewn under a presser foot 36; and feed dog mechanism 38 is provided to advance the work.

The hook body 14 is cup-shaped and receives a bobbin case 40. The plastic hook body includes as an integral part thereof, a rim 42 that is formed with a flat bearing surface 44, and the bobbin case is formed with a flange 46 that extends part way therearound. Flange 46 rests on the bearing surface 44 of rim 42. A bracket, which is not shown in the accompanying drawings, but which may be of the type disclosed in U.S. Pat. No. 3,373,707 of The Singer Company, is carried in the bed and supports bobbin case locating means that engages the bobbin case flange to constrain the bobbin case radially, angularly and axially of the hook body.

A combined hook beak and needle guard member 48 according to the invention including hook beak portion 50 and needle guard portion 52 are mounted in the rim 42 of hook body 14. Preferably, the member 48 is metallic and has thereon a torque balancing arm 54 as shown in the drawings. Member 48 is mounted in rim 42 to pivot with the free end portion 56 of an arm 58 of a resilient material which is clamped by a screw 60 between a rigid plate 62 and a flat surface 64 formed on the rim 42. The screw 60 extends through plate 62 arm 58 and rim portion 66 to engage a threaded hole 68 in a flange 70 which is located behind portion 66 of the rim 42 and which is part of a spherically formed metal piece 72. The hook beak and needle guard member 48 is affixed to free end portion 56 of arm 53 with a nut 74 in engagement with a threaded stud 76 on the member 48. A locking element 78 notched at 80 to receive tangs 82 and 84 on end portion 56 of arm 58 and member 48 respectively prevents these parts from turning relative to each other on the stud 76.

A finger-like portion 86 of piece 70 extends into a slot 88 in rim 42 where it terminates in a throat 90 which is provided to receive needle thread of a loop caught by hook beak 50 during the operation of the sewing machine. Since the piece 70 is a metal part, it suffers little wear in the throat 90 as the result of the rubbing action of thread caught therein. This is in contrast to the substantial wear which would be experienced as a consequence of thread rubbing directly against the side of a throat in the plastic hook body 14.

As shown, the hook body 14 is connected to the shaft 16 for rotation thereby by means of a plastic plate 92, metal plate 95, and by screws 96, 98 and 100 which draw the metal plate up against the bottom of the hook body and squeeze plastic plate 92 and the hook body against opposite sides of a step 102 on a flange 104 which is an integral part of shaft 16. Any other suitable connection providing for rotation of the hook body 15 by the shaft 16 may, however, be provided.

Figure 5:
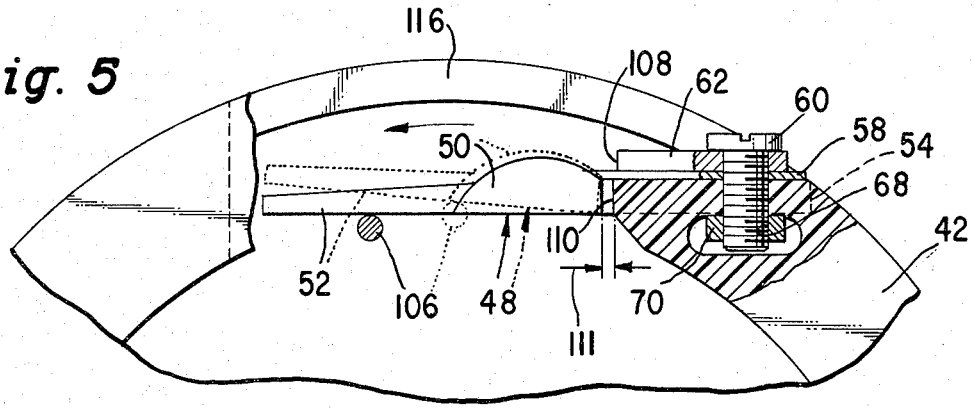
FIG. 5 is a fragmentary top plan view of the hook of the invention partially in section and showing the combined needle guard and hook beak in both a normal and a displaced position.

It is a well known fact that a needle will sometimes be bent or be deflected by the material being sewn from the position in which it can properly cooperate with the hook beak for loop formation, and that the hook beak of a conventional type hook may collide with a needle which has been so disposed and be damaged or cause the needle to be broken. With the hook of the present invention, any such collision between the needle and hook beak is prevented by the needle guard 52 which is disposed to contact a needle, bent or deflected into the path of the hook beak 50. As the hook beak approaches such a needle 106, the needle guard is pushed by the needle in an outward direction in the rim 42, and arm portion 56 is caused to flex about a pivotal axis substantially defined by edge 108 of plate 62 in close proximity to edge 110 on rim 42, and parallel to the axis of shaft 16. Hook beak 50 is moved with the needle guard from the solid to the dotted line position of FIG. 5 and damage to these parts is thereby prevented. As the guard and hook beak moves beyond the needle, the combined needle guard and hook beak member 48 is returned, by reason of the natural resiliency of arm 58, to its original position. An operator is therefor afforded the opportunity of replacing the needle or taking any other corrective action providing for a proper disposition of the needle relative to the hook beak before the hook is damaged or the needle broken.

In the absence of any irregularities, the hook of the invention functions in the usual manner during a sewing operation, that is, as the needle is reciprocated and caused to pass in close proximity to the beak of the hook, the hook seizes a loop of thread thrown out by the needle during its return stroke to provide for proper stitch formation.

The effect of centrifugal force on the position in the rim 42 of member 48 considered as a unit including the hook beak 50, needle guard 52, and torque balancing arm 54 is minimized by the short length 111 of the free arm portion 56 of arm 58 that can flex which is the portion extending from the edge 108 of plate 62 to edges 112 and 114 on locking element 78 and the member 48 respectively. Further, the effect of centrifugal force on the position of hook beak 50 and needle guard 52 is counterbalanced by centrifugal force on the torque balancing arm 54 located on the opposite side of the pivotal axis for member 48 from the hook beak and needle guard. A metal ring 116 suitably affixed to the hook 12 is provided with increased mass 118 diametrically opposite member 48 to balance out the mass of the member 48 and so prevent vibration problems during rotation of the hook. The torque balancing arm 54 extends under and contacts such ring 116.

It is to be understood that the present disclosure relates to a preferred embodiment of the invention which is for purposes of illustration only and that various modifications may be made therein without departing from the spirit and scope of the invention as defined in the appended claims.

I claim:

1. The combination of claim 1 including torque balancing means operably connected with the combined needle guard and hook beak for counterbalancing the effect of centrifugal force thereon during rotation of the hook body.

2. A sewing machine hook including a hook body with an outer rim, a shaft for rotating the hook body, a combined needle guard and hook beak mounted in said rim for rotation thereby and for pivotal movement about an axis substantially parallel to the shaft axis, the combined needle guard and hook beak being disposed on one side of said axis with the guard positioned for contact by a needle in the path of rotation of the hook beak and so as to cause the combined needle guard and hook beak to be pivoted by the needle into a position effective to prevent the hook beak from engaging the needle, and a torque balancing arm for the combined needle guard and hook beak on the opposite side of said axis therefrom.

3. A sewing machine hook including a hook body with an outer rim, a shaft for rotating the hook body, a combined needle guard and hook beak mounted in said rim for rotation thereby; and a flexible member secured to the combined needle guard and hook beak, and to the hook rim, the flexible member being supported against an edge of the rim, and in close proximity to such rim edge against the combined needle guard and hook beak to define a pivotal axis for the needle guard and hook beak substantially parallel to the shaft axis; the needle guard being disposed for contact by a needle in the path of rotation of the hook beak and so as to cause the combined needle guard and hook beak to be pivoted by the needle into a position effective to prevent the hook beak from engaging the needle.

4. A sewing machine hook including a hook body with an outer plastic rim; a shaft for rotating the hook body; a combined needle guard and hook beak which is metallic, the combined needle guard and hook beak mounted in the rim for rotation thereby and for pivotal movement about an axis substantially parallel to the shaft axis, the needle guard being disposed for contact by a needle in the path of rotation of the hook beak and so as to cause the combined needle guard and hook beak to be pivoted by the needle into a position effective to prevent the hook beak from engaging the needle; and a metallic ring on the hook provided with increased mass in a region diametrically opposite to the combined needle guard and hook beak.

5. A sewing machine hook including a hook body with an outer rim, a shaft for rotating the hook body, a combined needle guard and hook beak mounted in said rim for rotation thereby and for pivotal movement about an axis substantially parallel to the shaft axis, the combined needle guard and hook beak being disposed on one side of said axis with the guard positioned for contact by a needle in the path of rotation of the hook beak and so as to cause the combined needle guard and hook beak to be pivoted by the needle into a position effective to prevent the hook beak from engaging the needle, and a torque balancing arm for the combined needle guard and hook beak on the opposite side of said axis therefrom, the hook rim being at least partially non-metallic, the needle guard and hook combination being metallic and mounted in the non-metallic portion of the rim of the hook body, the hook being provided with a metallic ring having increased mass in a region diametrically opposite to the needle guard and hook beak, and said torque balancing arm extending under the metallic ring.

* * * * *

CERTIFICATE OF CORRECTION

Patent No. 4,278,038 Dated July 14, 1981

Inventor(s) Ralph E. Johnson

It is certified that error appears in the above-identified patent and that said Letters Patent are hereby corrected as shown below:

Column 2, line 56, after "arm" delete 53 and insert 58.

Renumber Claims 1 through 5 sequentially as 2, 3, 4, 5 and 6.

Add Claim 1 as follows:

1. A sewing machine hook including a hook body with an outer rim, a shaft for rotating the hook body, a combined needle guard and hook beak mounted in said rim for rotation thereby and for pivotal movement about an axis substantially parallel to the shaft axis, the needle guard being disposed for contact by a needle in the path of rotation of the hook beak and so as to cause the combined needle guard and hook beak to be pivoted by the needle

UNITED STATES PATENT AND TRADEMARK OFFICE

CERTIFICATE OF CORRECTION

PATENT NO. : 4,278,038

DATED : July 14, 1981

INVENTOR(S) : Ralph E. Johnson

It is certified that error appears in the above—identified patent and that said Letters Patent is hereby corrected as shown below:

into a position effective to prevent the hook beak from engaging the needle.

On The Title Page, "5 Claims 5 Drawing Figures" should read -- 6 Claims 5 Drawing Figures --.

Signed and Sealed this

Eighth Day of December 1981

[SEAL]

Attest:

GERALD J. MOSSINGHOFF

Attesting Officer

Commissioner of Patents and Trademarks